US005104179A

United States Patent [19]

Jones

[11] Patent Number: 5,104,179

[45] Date of Patent: Apr. 14, 1992

[54] COMBINATION TABLE AND TOY DEVICE

[76] Inventor: Cary A. Jones, 11080 W. Saratoga Pl., Littleton, Colo. 80127

[21] Appl. No.: 561,115

[22] Filed: Aug. 1, 1990

[51] Int. Cl.[5] ..... A47D 1/08; A47C 13/00

[52] U.S. Cl. ..... 297/3; 297/258; 297/270; 297/157

[58] Field of Search ..... 297/258, 170, 3, 1, 297/272; 135/16; 108/27, 29; 298/539, 529, 534

[56] References Cited

U.S. PATENT DOCUMENTS

| | | | |
|---|---|---|---|
| 109,011 | 11/1870 | Hudson et al. . | |
| 326,968 | 9/1885 | Gibson | 297/270 |
| 927,234 | 10/1908 | Haley | 297/3 |
| 1,493,084 | 4/1922 | Strniste | 297/258 |
| 1,914,473 | 6/1933 | Wilson | 297/270 |
| 2,225,725 | 12/1940 | Spitzwieser | 297/270 |
| 2,705,524 | 4/1955 | Shipman | 297/258 |
| 2,743,146 | 5/1956 | Wheeler | 135/16 |
| 3,227,445 | 1/1966 | Jensen | 297/258 |
| 3,592,506 | 7/1971 | Breslow | 297/1 |
| 3,910,631 | 10/1975 | Inaba | 135/16 |
| 4,783,118 | 11/1988 | Ryan et al. | 297/258 |

FOREIGN PATENT DOCUMENTS

| | | | |
|---|---|---|---|
| 163012 | 5/1949 | Austria | 297/270 |
| 3605747 | 8/1987 | Fed. Rep. of Germany | 135/16 |

*Primary Examiner*—Laurie K. Cranmer
*Assistant Examiner*—Cassandra L. Hope
*Attorney, Agent, or Firm*—John L. Isaac

[57] ABSTRACT

A combination device is operable in a table position and a rocker toy position. The device includes a pair of spaced end members each defining a base edge terminating in a pair of end portions, the base edge supporting the device in its table position. A substantially curved edge portion interconnects the end portions of the base edge to form end corner portions, the curved edge portion supporting the device when in its rocker toy position. A platform having top and bottom surfaces extends between the end members. The top surface of the platform is accessible as a table top when the device is in its table position, and the platform's bottom surface is accessible as a foot rest when the device is in its rocker toy position. Finally, a pair of seat members extend between the end members proximate the end corner positions. Each seat member has a seating portion with top and bottom surfaces substantially parallel to the surfaces of the platform, and a support member interconnecting the end members and the seating portion to provide strength for the seat member. The top seating surface is accessible when the device is in its table position, and the bottom seating surface is accessible when the device is in its rocker toy position.

2 Claims, 2 Drawing Sheets

COMBINATION TABLE AND TOY DEVICE

BACKGROUND OF THE INVENTION

1. Field of the Invention

This invention relates generally to multi-purpose furniture articles and, more particularly, to devices which can be easily converted into multiple embodiments. Specifically, the present invention relates to a device which may be readily converted and used as both a rocking toy device as well as a picnic-type table.

2. Description of the Prior Art

Multi-purpose convertible furniture articles are well known in the art. For example, U.S. Pat. No. 1,933,015, U.S. Pat. No. 2,225,723, U.S. Pat. No. 2,269,834 and U.S. Pat. No. 4,205,876 all disclose multi-purpose articles of furniture useful for a variety of purposes such as cradles, tables, beds and the like. Frequently, however, these devices require disassembly or rearrangement of portions thereof in order to convert them from one particular functional use to another.

U.S. Pat. No. Des. 144,404, U.S. Pat. No. Des. 147,581 and U.S. Pat. No. Des. 147,873 all disclose combination chairs and table articles of various designs. In addition, U.S. Pat. No. 2,705,524 and U.S. Pat. No. 4,783,118 both disclose a convertible chair or desk in conjunction with a rocker toy. In the first instance, portions of the device must be removed and rearranged in order to change function. In the second instance, the disclosed invention is a combination rocker and highchair or desk not intended for multiple party use.

Thus, it would be desirable to have a combination device for use as a picnic-type table simultaneously usable by a number of individuals simultaneously as well as a rocker toy device capable of use by multiple numbers of children or adults, all without requiring the removal of parts or reassembly of portions thereof. However, such a need is yet to be filled by the existing art.

SUMMARY OF THE INVENTION

Accordingly, it is one object of the present invention to provide a combination table and rocking toy device.

It is another object of the present invention to provide a combination device useful as both a rocker toy as well as a picnic-type table adapted for simultaneous use by multiple parties.

A further object of the present invention is to provide a combination rocker toy and table device useful by a plurality of people which includes certain safety features to prevent overturning as well as to provide features enhancing safety of occupants of the rocker toy device.

To achieve the foregoing and other objects and in accordance with the purpose of the present invention as embodied and broadly described herein, a combination device is disclosed having a table position and a rocker toy position. The combination device includes a pair spaced end members each defining a base edge terminating in a pair of end portions with the base edge supporting the device in the table position. The end members also include a substantially curved edge portion interconnecting the end portions of the base edge to form end corner portions, the curved edge portion supporting the device in its rocker toy position. A platform extends between the end members and has top and bottom surfaces. The platform is aligned such that its top surface is accessible as a table top when the device is in its table position, and its bottom surface is accessible as a foot rest when the device is in its rocker toy position. A pair of seat members extend between the spaced end members proximate the end corner portions thereof. Each seat member has a seating bench portion with top and bottom surfaces substantially parallel to the surfaces of the platform, and a bench support member interconnecting the end members and the bench seating portion to provide strength for the seat member. The top seating surface is accessible when the device is in its table position, while the bottom seating surface is accessible when the device is in its rocker toy position.

BRIEF DESCRIPTION OF THE DRAWINGS

The accompanying drawings which are incorporated in and form a part of this specification, illustrate preferred embodiments of the present invention, and together with the description, serve to explain the principles of the invention. In the drawings.

DETAILED DESCRIPTION OF THE PREFERRED EMBODIMENTS

Figure 1:
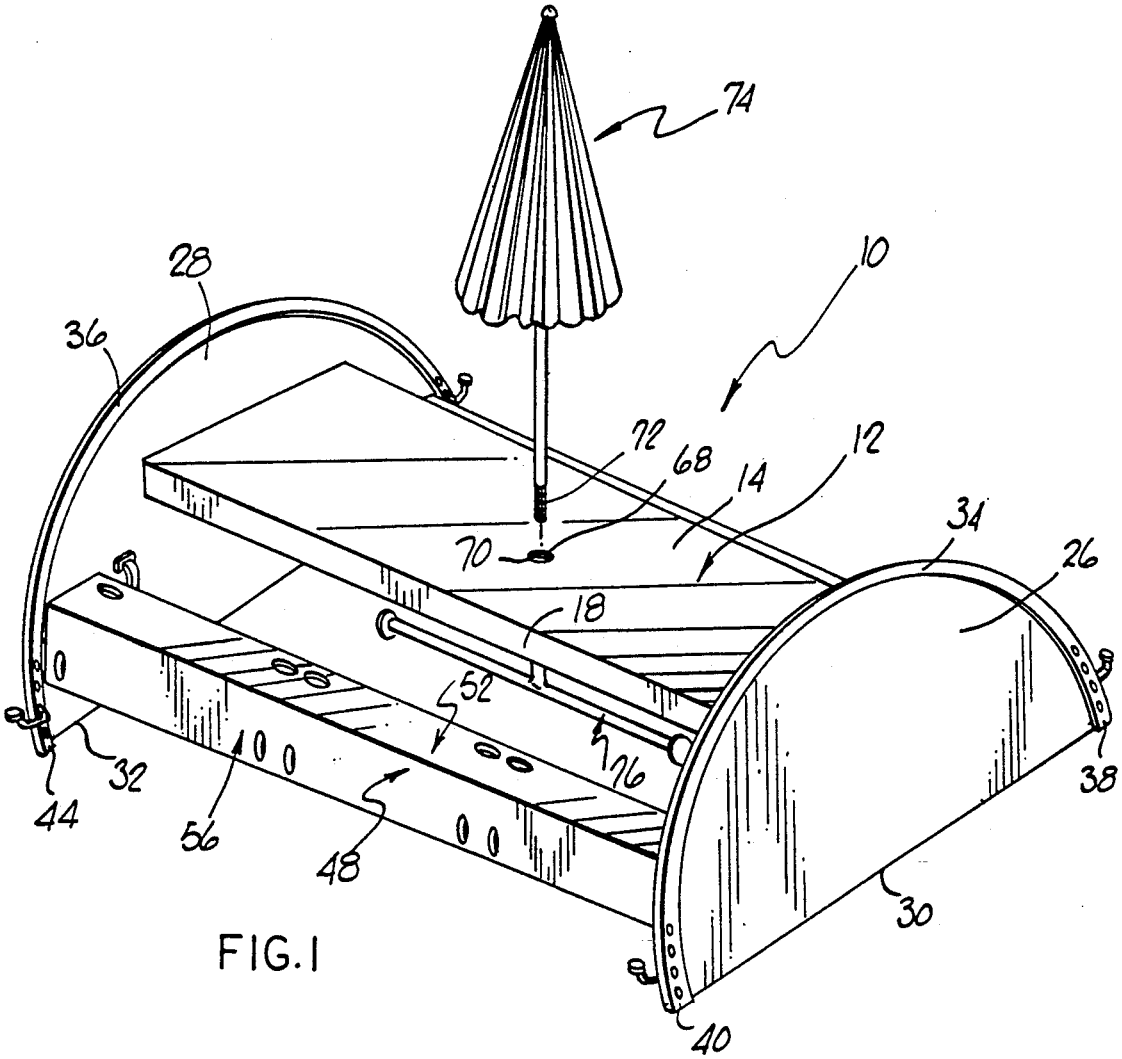
FIG. 1 is a side perspective view of the combination device in its upright, table position.
Figure 3:
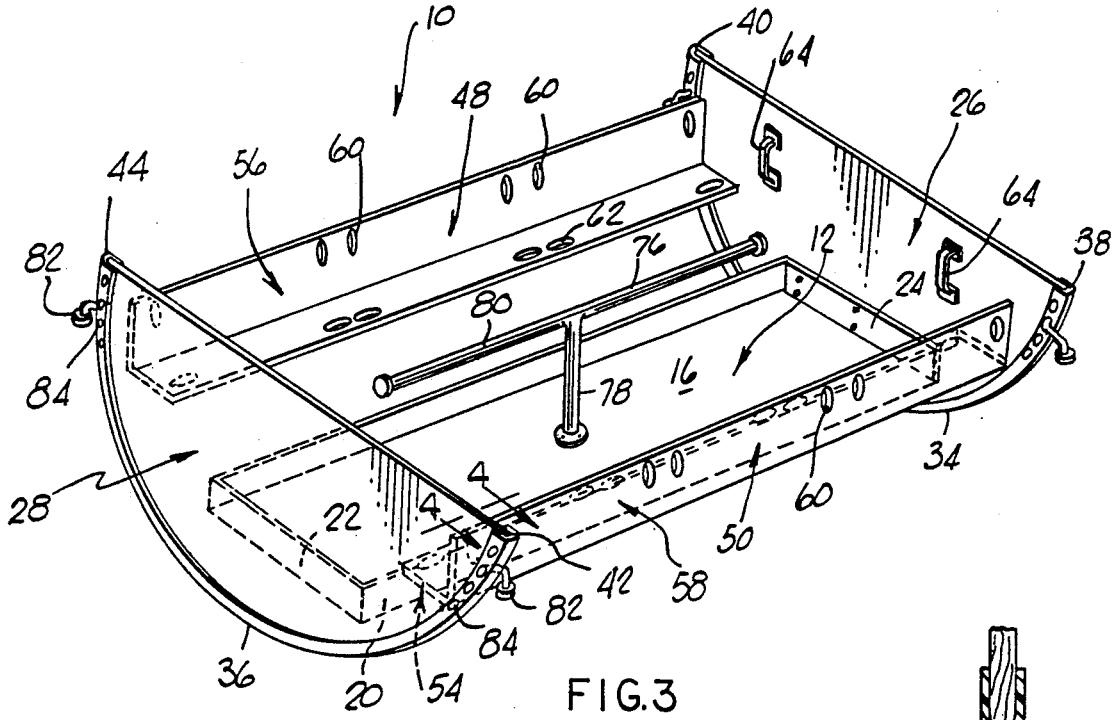
FIG. 3 is a perspective view of the embodiment illustrated in FIG. 1 showing the device in its rocker toy position.

Referring to FIGS. 1 and 3–5, in particular, a combination table and rocker toy device 10 is illustrated. The device 10 can be utilized in an upright table position as illustrated in FIG. 1 wherein the table is similar to a picnic-type table having bench seats for multiple person use. In the alternative, the device 10 may be utilized in an inverted position as a rocker toy device as illustrated in FIG. 3.

The device 10 preferably includes a platform 12 having an upper surface 14 and a bottom surface 16. The platform 12 is preferably elongated and substantially rectangular in shape and, in preferred form, includes side edges 18 and 20. In preferred form, the side edges 18 and 20 are a pair of depending plates relative to the device 10 when in its upright position, as illustrated in FIG. 1. A pair of end edge members 22 and 24 are also provided so as to create a totally enclosed area surrounding the bottom surface 16 of the platform 12 when the device 10 is in its inverted position as illustrated in FIG. 3.

Platform 12 is secured at each end 22, 24 to end members 26 and 28. The end members 26 and 28 provide support for the platform 12 relative to the ground surface. Each end member 26, 28 includes a flat bottom surface or edge 30, 32, respectively, which acts as a support for the device 10 in its upright position as illustrated in FIG. 1. Each end member 26, 28 also includes a curved edge portion 34, 36, respectively, which interconnects the ends of the flat edge portions 30, 32 so as to form end corners 38, 40 and 42, 44 respectively. In preferred form, each curved edge portion 34, 36 is in the form of a substantially continuous curve between the corners 38, 40 and 42, 44. In the most preferred embodiment, the curved edge portions 34, 36 are semi-circular arcs. The curved edges 34, 36 provide the surface supports for the device 10 when the device 10 is in its inverted rocker toy position as illustrated in FIG. 3. As can be seen from FIG. 1, when the device 10 is in its table position so as to be supported by the flat edges 30, 32, the device 10 is stable and essentially non-movable. However, when the device 10 is inverted so as to be supported along the curved surfaces 34, 36, the device 10 is readily movable in a rocking-fashion along the curved surfaces 34, 36 so as to provide a rocker toy for individuals seated within the device 10 as described below.

A pair of bench seat members 48, 50 are provided along each side edge of the device 10. The bench members 48, 50 include a seating plate or platform 52, 54, respectively, which provide seating portions for the device 10 supported by brace or ledge members 56, 58, respectively, which provide different functions depending on whether device 10 is in its table or rocker toy position. When the device 10 is in its table position as illustrated in FIG. 1, the upper surfaces of the seat portions 52, 54 provide seating surfaces for individuals using the table device 10. The ledges or brackets 56, 58 function, in this embodiment, as a structural support in order to support the weight of individuals sitting on the surfaces of the seating portions 52, 54. When the device 10 is in its inverted position as illustrated in FIG. 3, the bottom surfaces of the seating portions 52, 54 also serve as seating areas for individuals utilizing the rocker toy of FIG. 3.

In this embodiment, the ledges or braces 56, 58 function as back rest supports for individuals using the device 10 in its rocker toy position so that the individuals seated on the seating portions 52, 54 with their backs against the back rests 56, 58 can provide weight leverage in order rock the device 10 along the curved surfaces 34, 36. To this end, hand holds 60 are provided in the back ledge 56 as well as hand holds 62 being provided in the seating portion 52. These hand holds 60 and 62 are particularly useful in the rocker toy embodiment illustrated in FIG. 3 for they permit users of the device 10 to grab the bench seats 48, 50 to provide and assist in leveraging their weight in order to rock the device 10 along the surfaces 34, 36. Additional safety measures include hand holds 64 along the inner surface portions of the end members 26, 28. These hand holds 64 are primarily for allowing the operators of the device 10 in FIG. 3 to obtain some stability while the device 10 is in a rocking operation.

Figure 4:
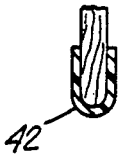
FIG. 4 is an enlarged sectional view taking substantially along line 4—4 of FIG. 3.

Referring to FIG. 4, the curved edge portions 34, 36 are preferably covered by a of protective cover and preferably a Teflon or other plastic sleeve so as to prevent degradation and degeneration of the edge portions 34, 36 as the device 10 rocks along the ground surface in use as a rocker toy. This plastic sleeve 66 may be made from any desired material useful in providing such a protective function.

Figure 5:
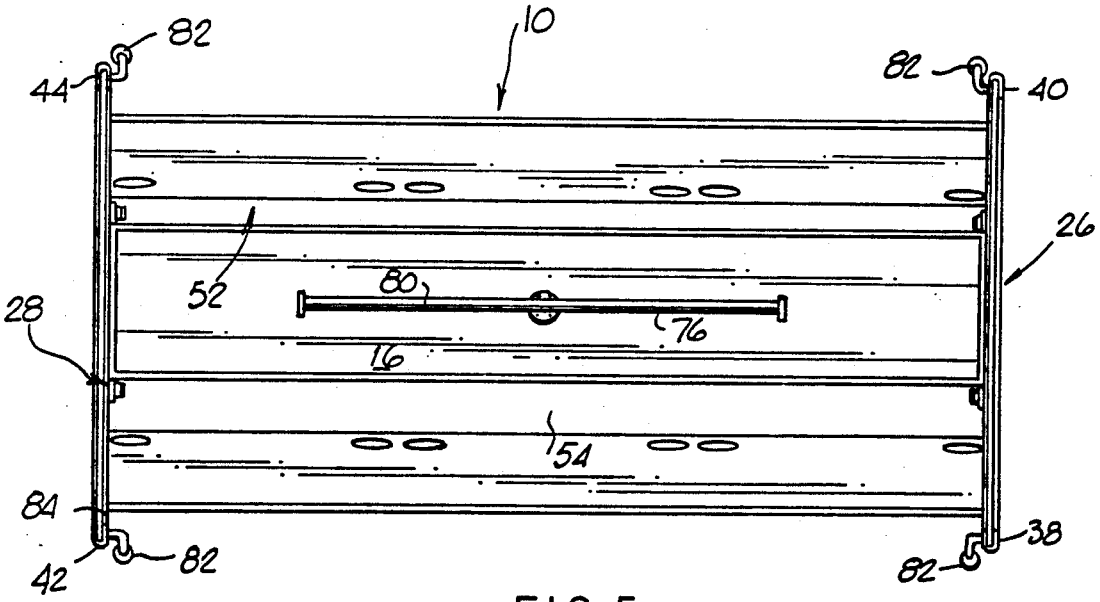
FIG. 5 is a top plan view of the embodiment illustrated in FIG. 3.

Referring to FIGS. 1, 3 and 5, a central aperture 68 is preferably provided at the approximate center point of the platform 12 and includes a threaded sleeve 70 therein. The threaded sleeve 70 is sized and shaped in order to receive a male thread member 72 disposed at the end of an umbrella 74. In this manner when the device 10 is used in its table position as illustrated in FIG. 1, the umbrella 74 may be attached to the platform 12 by threadably engaging the male thread member 72 with the sleeve 70. Consequently, the umbrella 74 is removably attachable in a secured manner to the device 10. When the device 10 is in its inverted rocker toy position as illustrated in FIG. 3, a T-handle may be threadably engaged into the sleeve 70 in similar fashion. In this embodiment, the T-handle 76 may include a threaded male member (not illustrated) which is engageable within the sleeve 70 from the bottom surface 16 of the platform 12. The T-handle 76 includes a base attachment member 78 which is engaged with the sleeve 70 and a cross-bar handle 80 which is substantially parallel to the bottom surface 16 of the platform 12. In this manner, individuals seated in the seating portions 48, 50 may grab the bar member 76 for safety purposes as well as to provide and assist in the rocking of the device 10.

As a safety precaution, the device 10 is preferably be provided with stop members 82 disposed along the curved portions 34, 36. The stop members 82 are attachable to one of several spots along the curved portions 34, 36 defined by apertures 84 disposed therein. Thus, the stop members 82 may be placed at the desired positions along the curved edges 34, 36. The stops 82 provide safety by preventing over turning of the device 10 when in its rocker toy position and being rocked along the curved edges 34, 36, for the stop members 82 engage the ground surface and prevent further rocking past that point on the curved portions 34, 36. Depending on the desired amount of rocking, the stop members 82 may be located at appropriate positions along the curved surfaces 34, 36.

Figure 2:
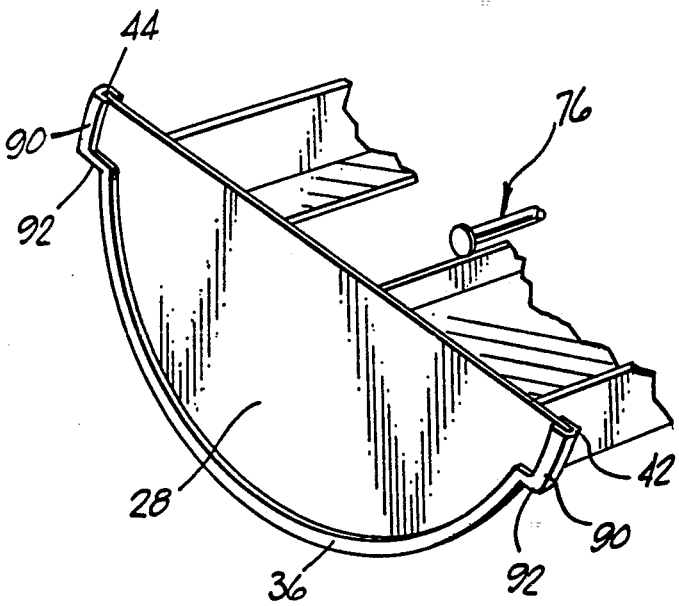
FIG. 2 is a perspective view of an end portion, with some parts cut away, of a second embodiment of the present invention and illustrating the device in its rocker toy position.

Referring to FIG. 2, an alternate embodiment illustrating a different type of stop member is shown therein. In this manner, the end member 28 includes a pair of lip members 90 projecting radially outwardly from the curved surface 36 proximate the corners 42, 44. The lip members 90 include a shoulder surface 92 which is substantially perpendicular to the circumferential surface of the curved portion 36 so as to provide a stop member for engagement with the ground surface and thereby prevent further rocking past that point. The arrangement of the lip members 90 on the end members 26 is the same as that described above and illustrated in FIG. 2.

In operation, the device 10 readily functions as a picnic table depending on the size thereof. The device 10 may be made from wood, molded plastic or any other selected appropriate material. Moreover, the device 10 may be constructed in a small version for children, a large version for adults, or as a baby doll version for toy dolls. In its preferred embodiment, the device 10 is utilized as a picnic table whereby three adults may readily sit along the bench seat members 48, 50 and utilize the platform 12 as an eating surface or picnic table surface. To convert the device 10 to its rocker toy position, the umbrella 74 is removed, if it had been originally in place, and the device 10 is then simply inverted so as to be supported by the curved surfaces 34, 36. At this juncture, the device 10 then assumes its rocker toy position and may be readily rocked back and forth along the curved surfaces 34, 36 by individuals seated within the seating portions 48, 50, their feet being positioned on the bottom surface 16. By moving their weight back and forth, operators of the device 10 in its rocking toy position may readily initiate and maintain rocking motion of the device 10 along the surfaces 34, 36. The stop members 82 or 90 prevent overturning of the device 10 when being used in its rocker toy formation. If desired, the T-handle 76 may be inserted within the platform 12 prior for use with the device 10 as a rocker toy.

As it can be seen from the above, the present invention provides a simple yet effective combination device whereby the device may function as a utilitarian picnic table or other type of food table both for indoor and outdoor use as well as function as for an amusement device for children after dinner by simply inverting the table to its rocker toy position. The present invention achieves these multiple functions without having to add or subtract parts or portions or to convert sections thereof in order to change the device 10 from one embodiment to another. Moreover, the device 10 may be constructed from inexpensive materials and manufactured relatively easily. In addition, numerous safety features are provided with the present invention so as to permit users of the rocker toy embodiment to escape harm through inadvertent accidents.

While the foregoing description and the illustration of the present invention have been particularly shown in detail with reference to preferred embodiments and modifications thereof, it should be understood by those skilled in the art that the foregoing and other modifications are exemplary only, and that equivalent changes and detail may be employed without departing from the spirit or scope of the present invention as claimed excepted as precluded by the prior art.

What is claimed is:

1. A combination device operable in a table position and in a rocker toy position, said device comprising:

a pair of spaced end members each defining a base edge terminating in a pair of end portions, said base edge supporting said device in said table position, and a substantially curved edge portion interconnecting the end portions of said base edge to form end corner portions, said curved edge portion supporting said device in said rocker toy position;

a platform having top and bottom surfaces and extending between said end members, the top surface of said platform being accessible as a table top when said device is in said table position, and the bottom surface of said platform being accessible as a foot rest when said device is in said rocker toy position;

a pair of seat members extending between said spaced end members proximate said end corner portions, each said seat member having a seating bench portion with top and bottom surfaces substantially parallel to the surfaces of said platform, and a bench support member interconnecting said end members and said seating bench portion to provide strength for said seat member, said top surface of said seating bench portion being accessible when said device is in said table position, and said bottom seating surface being accessible when said device is in said rocker toy position; and means for limiting the angular movement of said combination device along said curved edge portion to prevent overturning of said device when the combination device is being utilized in its rocker toy position, said end portions each including a plurality of apertures disposed through the edges thereof with said limiting means comprising removable foot members attachable through said apertures and extending substantially perpendicular to said curved edge portion.

2. A combination device operable in a table position and in a rocker toy position, said device comprising:

a pair of spaced end members each defining a base edge terminating in a pair of end portions, said base edge supporting said device in said table position, and a substantially curved edge portion interconnecting the end portions of said base edge to form end corner portions, said curved edge portion supporting said device in said rocker toy position;

a platform having top and bottom surfaces and extending between said end members, the top surface of said platform being accessible as a table top when said device is in said table position, and the bottom surface of said platform being accessible as a foot rest when said device is in said rocker toy position;

a pair of seat members extending between said spaced end members proximate said end corner portions, each said seat member having a seating bench portion with top and bottom surfaces substantially parallel to the surfaces of said platform, and a bench support member interconnecting said end members and said seating bench portion to provide strength for said seat member, said top surface of said seating bench portion being accessible when said device is in said table position, and said bottom seating surface being accessible when said device is in said rocker toy position; and means for limiting the angular movement of said combination device along said curved edge portion to prevent overturning of said device when the combination device is being utilized in its rocker toy position, said limiting means comprising a lip member projecting from said curved end portion to provide a shoulder proximate said end corner portions, said shoulder projecting substantially perpendicular to said curve edge portions.

* * * * *